US006700495B2

(12) United States Patent
Mindermann et al.

(10) Patent No.: US 6,700,495 B2
(45) Date of Patent: Mar. 2, 2004

(54) FLAME MONITOR FOR AN OIL- AND GAS-OPERATED BURNER

(75) Inventors: Kurt-Henry Mindermann, Ratingen (DE); Mirko Loncaric, Wuppertal (DE)

(73) Assignee: BFI Automation, Ratinger (DE)

( * ) Notice: Subject to any disclaimer, the term of this patent is extended or adjusted under 35 U.S.C. 154(b) by 87 days.

(21) Appl. No.: 10/005,488

(22) Filed: Nov. 9, 2001

(65) Prior Publication Data

US 2002/0081545 A1 Jun. 27, 2002

(30) Foreign Application Priority Data

Nov. 11, 2000 (DE) ..... 100 55 831

(51) Int. Cl.[7] ..... G08B 17/12

(52) U.S. Cl. ..... 340/577; 340/578; 340/500; 340/501; 340/579; 431/79; 250/554; 250/339

(58) Field of Search ..... 340/577, 578, 340/500, 501, 579; 431/79; 250/554, 339

(56) References Cited

U.S. PATENT DOCUMENTS 5,126,721 A * 6/1992 Butcher et al. ..... 340/578
5,424,554 A * 6/1995 Marran et al. ..... 250/554
6,261,086 B1 * 7/2001 Fu ..... 431/79

* cited by examiner

*Primary Examiner*—Daniel J. Wu
*Assistant Examiner*—Tai T. Nguyen
(74) *Attorney, Agent, or Firm*—Patterson, Thuente, Skaar & Christensen, P.A.

(57) ABSTRACT

The invention relates to a flame monitor for an oil- or gas-operated burner, having a photosensor which detects the optical flame radiation and an evaluation circuit which is connected downstream of said photosensor and ascertains whether the radiation received by the photosensor corresponds to that of a burning flame and, in the event of a negative result, generates a switch-off signal for the fuel supply, wherein the evaluation circuit determines the number of zero crossings of the processed signal of the photosensor within a predetermined unit of time and compares it with a predetermined limit value, a switch-off signal for the fuel supply being generated when said limit value is undershot, the signal of the photosensor, freed from the DC voltage component and noise, being processed by corresponding amplification to form square-wave pulses.

6 Claims, 3 Drawing Sheets

FLAME MONITOR FOR AN OIL- AND GAS-OPERATED BURNER

FIELD OF THE INVENTION

The invention relates to a flame monitor for an oil- or gas-operated burner.

BACKGROUND OF THE INVENTION

German Patent DE 197 46 786 C2 discloses a flame monitor for blue-burning flames of an oil or gas burner, in which use is made of a semiconductor detector with a spectral sensitivity in the near ultraviolet with an evaluation circuit connected downstream, which influences a regulator for the fuel/combustion air ratio in accordance with the spectral distribution of the flame radiation. However, when the flame radiation shifts toward longer wavelengths, the "yellow region", this can lead to problems such that, despite the proportion of combustion air being increased, the shift increases and the fuel supply is thereupon switched off. Evaluation of the radiation received by the photosensor with regard to whether the burner is burning or, in the case where it is not burning, the fuel supply is to be switched off as far as possible immediately, is not provided in this case.

German Patent DE 198 09 653 C1 discloses a flame monitor for blue-burning flames of an oil or gas burner, which has a photosensor which detects the flame radiation and whose sensitivity rises sharply from ultraviolet to infrared, and comprises an evaluation circuit which is connected downstream and switches off the fuel supply if the radiation falls within the range from 200 to 500 nm or the increase in the detected radiation intensity above 500 nm indicates movement out of the blue region. In this case, the signal of the photosensor is evaluated in a two-channel manner, one relating to ultraviolet radiation up to 500 nm and the other relating to visible and infrared radiation. A special photosensor with special evaluation is required in this case.

SUMMARY OF THE INVENTION

It is an object of the invention to provide a flame monitor which enables identification of whether the burner is burning, i.e. a flame is present, in a very simple manner.

According to the invention there is provided a flame monitor for an oil- or gas-operated burner, having a photosensor which detects the optical flame radiation and the pulsation thereof, and having an evaluation circuit which is connected downstream of said photosensor and ascertains whether the radiation received by the photosensor corresponds to that of a burning flame and, in the event of a negative result, generates a switch-off signal for the fuel supply, wherein the evaluation circuit determines the number of zero crossings of the processed signal of the photosensor within a predetermined unit of time and compares it with a predetermined limit value, a switch-off signal for the fuel supply being generated when said limit value is undershot, the signal of the photosensor, freed from the DC voltage component and noise, being processed by corresponding amplification to form square-wave pulses.

Further objects, advantages and embodiments of the invention will become apparent from the following description and the claims.

BRIEF DESCRIPTION OF THE DRAWINGS

The invention is explained in more detail below with reference to accompanying figures.

DETAILED DESCRIPTION OF A PREFERRED EMBODIMENT

A flame of an oil- or gas-burner burns optimally when there is a small stoichiometric excess of air, i.e. the lambda value is slightly greater than one. If the lambda value rises further, then the intensity of the flame radiation increases, which also happens, however, if the lambda value falls below one. In the case of a lambda value of greater than one, the optical frequencies of the flame radiation shift toward larger values when the proportion of combustion air is increased, and in the case of a lambda value of less than one, the optical frequencies of the flame radiation shift toward smaller values when the proportion of combustion air is reduced. In the latter case, however, the development of soot then also rises sharply (cf. diagram of FIG. 1, in which curve A shows measured values with regard to the development of soot, specified in Bacharach, plotted against the lambda value), which is why in this case, when the regulation does not result in the fuel/combustion air mixture being returned to the optimum range within a predetermined time, the fuel supply should expediently be interrupted.

With the use of a photosensor which detects the flame radiation, and whose sensitivity rises sharply from ultraviolet to infrared, and an evaluation circuit which is connected downstream and generates a signal which corresponds to the photosensor signal, integrated over a predetermined time, with regard to the radiation in the region of relatively long wavelengths, for instance >500 nm, the signal thus generated can be plotted, with respect to lambda. A burner-specific curve B in accordance with the diagram of FIG. 1 is then obtained.

It can be seen from curve B that there is a minimum at a lambda value of about 1 and curve B rises from there both toward higher and toward lower lambda values.

Accordingly, the evaluation circuit can evaluate the signal of the photosensor with regard to flicker frequency and/or amplitude of the detected flame radiation and, upon ascertaining the shift in the flame radiation at a flicker frequency below a predetermined value, can generate a signal for increasing the proportion of combustion air in the fuel/combustion air mixture and, in the event of the predetermined second value being exceeded, can generate a signal for reducing the proportion of combustion air in the fuel/combustion air mixture.

Figure 1:
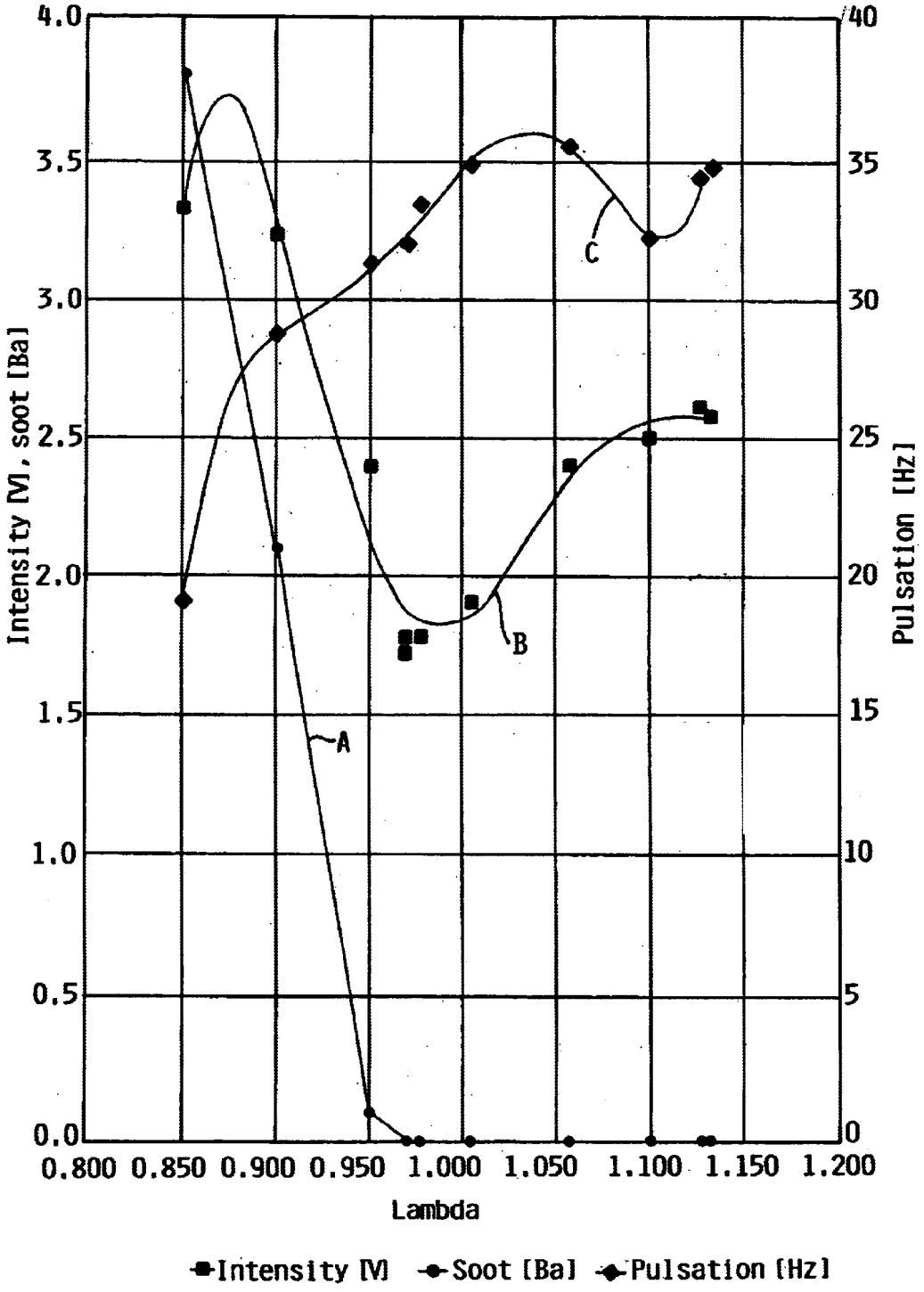
FIG. 1 shows a diagram relating to various quantities, plotted against the lambda value.
Figure 2:
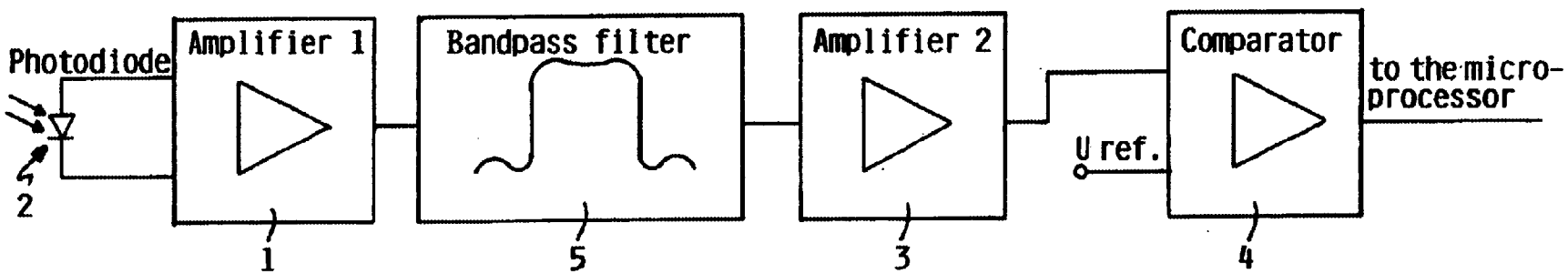
FIG. 2 schematically shows a circuit diagram for a regulating device.

The diagram of FIG. 1 furthermore contains a curve C, which relates to "zero crossings", designated here as pulsation (Hz), of the signal—amplified by an amplifier 1—of the photodetector 2 which detects the flame radiation, plotted with respect to lambda. These zero crossings per unit of time essentially correspond to the flicker frequency of the flame radiation. These zero crossings are generated by the evaluation circuit by the DC component of the signal of the photosensor being clipped and the zero line for the AC component being positioned such that the noise component of the signal is suppressed, i.e. that the dominant amplitudes remain. The resulting AC voltage signal is amplified, amplifier 3, in such a way that essentially square-wave pulses having varying pulse widths are produced on account of the clipping of the upper and lower sections. Rising and/or falling edges of these square-wave pulses and thus zero crossings are then correspondingly counted. This is done per unit of time, for example per second. If the number of zero crossings per unit of time is greater than a predetermined limit value, for example 25, it is assumed that a flame is present. If the number of zero crossings is less than or equal to the predetermined limit value, it is assumed that no flame is present, and a signal for interrupting the fuel supply can accordingly be generated. When evaluating the zero crossings, it is possible to dispense with a special photodetector and the two-channel evaluation of its signal according to German Patent DE 198 09 653 C1.

For evaluation, use is expediently made of a comparator 4 either with a counter connected downstream, a shift register and evaluation or a microprocessor 5, which realizes the functions of these components and the generation of a switch-off signal when a flame is absent. Low frequencies of for instance <30 Hz can be clipped beforehand by means of a high-pass filter 6, so that they do not enter into the evaluation.

Figure 3:
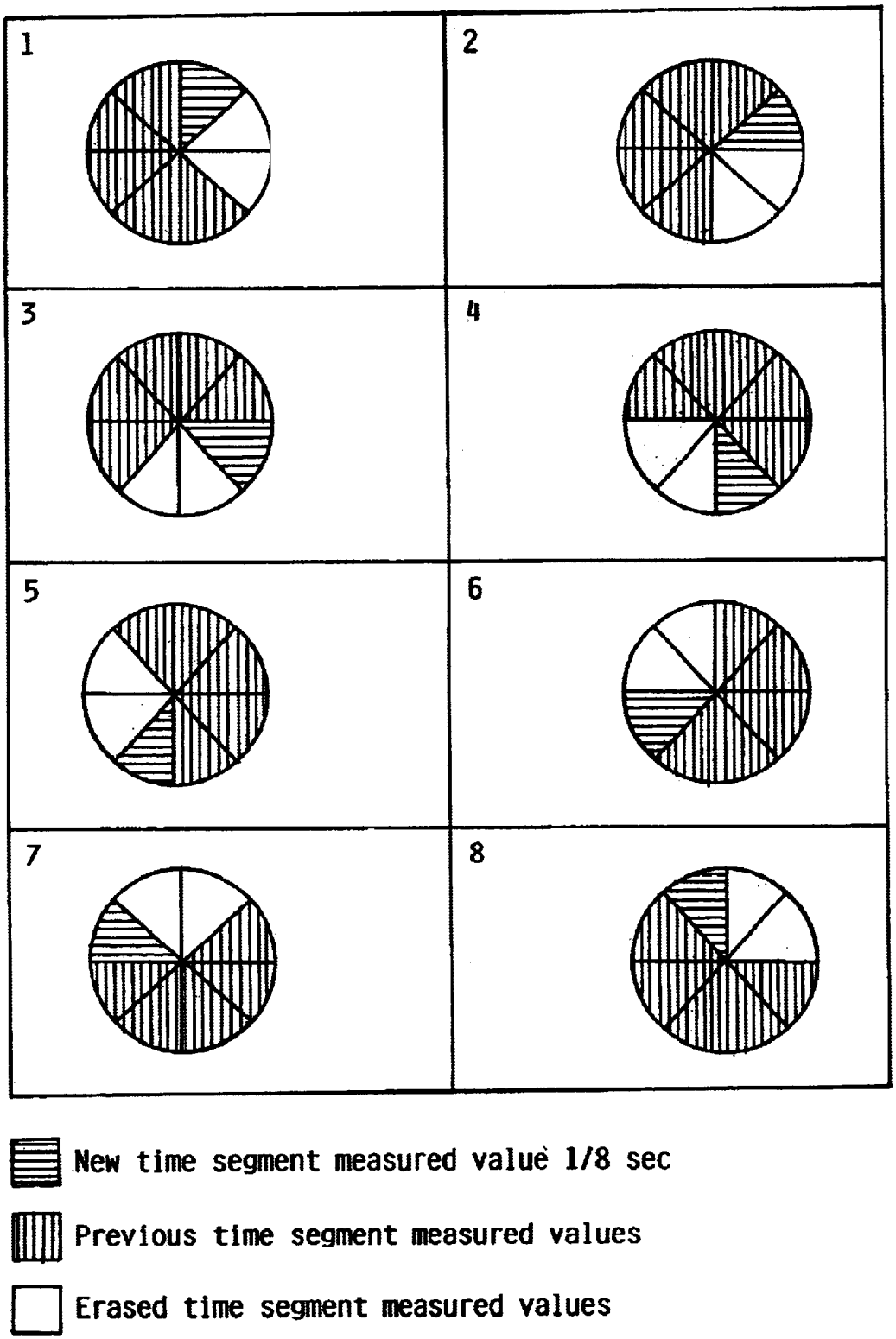
FIG. 3 diagrammatically shows the formation of measured values for the flicker frequency of the flame radiation.

Since the limit value for a switch-off is relatively small and periods in which no zero crossing is ascertained can occur within the predetermined time, it is expedient to subdivide the predetermined time into a multiplicity of segments, for example six to ten, in which the zero crossings are counted separately, which are then added in each case after the elapsing of a segment for a predetermined time, in order to be able to compare corresponding values, in each case after the elapsing of such a segment for a predetermined time, with the limit value. This is illustrated schematically in FIG. 3. As a result of this, the switch-off times that are demanded in the case of gas and oil burners, for example 1 sec in the case of a gas burner, can readily be complied with. When generating the respective value for the number of zero crossings, in each case the number of the chronologically first segment is omitted and the number of the chronologically last segment is added, with the result that the value is updated after each segment and can be compared with the limit value. The abovementioned shift register function is required for this purpose.

With this type of flame monitoring, which is extremely simple, there are, moreover, no problems with regard to setting the sensitivity, so that it can also be handled in an extremely simple manner. Overdriving is unimportant in this case since the square-wave pulses are not essentially impaired as a result of this. The flame monitor can be used together with any type of regulating devices for the fuel/combustion air mixture.

Furthermore, it is expedient to use an optical filter upstream of the photosensor, which filter has an absorbing action essentially in a wavelength range which corresponds to the radiation from incandescent furnace walls (greater than about 900 nm), in order that flicker which can be generated in the absence of a flame, by virtue of the fact that air is being swirled by a fan in the furnace, is not confused with the actual flicker of a flame.

While the invention has been shown and described with reference the preferred embodiment, it should be apparent to one ordinary skilled in the art that many changes and modifications may be made without departing from the spirit and scope of the invention as defined in the claims.

What is claimed is:

1. A flame monitor for an oil- or gas-operated burner, having a photosensor which detects the optical flame radiation and the pulsation thereof, and having an evaluation circuit which is connected downstream of said photosensor and ascertains whether the radiation received by the photosensor corresponds to that of a burning flame and, in the event of a negative result, generates a switch-off signal for the fuel supply, wherein the evaluation circuit determines the number of zero crossings of the processed signal of the photosensor within a predetermined unit of time and compares it with a predetermined limit value, a switch-off signal for the fuel supply being generated when said limit value is undershot, the signal of the photosensor, freed from the DC voltage component and noise, being processed by corresponding amplification to form square-wave pulses.

2. The flame monitor of claim 1, wherein the rising or falling edges of the signal can be counted by the evaluation circuit.

3. The flame monitor of claim 2, wherein the evaluation circuit has a comparator with a counter connected downstream.

4. The flame monitor of claim 1, wherein the predetermined unit of time is subdivided by the evaluation circuit into a multiplicity of segments, the number of zero crossings being determined at the end of each segment.

5. The flame monitor of claim 4, wherein the segments form a fraction of the required burner switch-off time upon ascertaining the absence of a flame.

6. The flame monitor of claim 1, wherein an optical filter is connected upstream of the photosensor and essentially absorbs radiation corresponding to that from incandescent furnace walls.

* * * * *